US007276991B2

(12) United States Patent
Rubel

(10) Patent No.: US 7,276,991 B2
(45) Date of Patent: Oct. 2, 2007

(54) MULTIPLE SWITCH MEMS STRUCTURE AND METHOD OF MANUFACTURE

(75) Inventor: Paul J. Rubel, Santa Barbara, CA (US)

(73) Assignee: Innovative Micro Technology, Goleta, CA (US)

( * ) Notice: Subject to any disclaimer, the term of this patent is extended or adjusted under 35 U.S.C. 154(b) by 210 days.

(21) Appl. No.: 11/221,745

(22) Filed: Sep. 9, 2005

(65) Prior Publication Data

US 2007/0057746 A1 Mar. 15, 2007

(51) Int. Cl.
*H01P 1/10* (2006.01)

(52) U.S. Cl. ..... 333/101; 333/105; 333/262

(58) Field of Classification Search ..... 333/101, 333/103, 104, 105, 107, 262; 200/181
See application file for complete search history.

(56) References Cited

U.S. PATENT DOCUMENTS 5,943,223 A 8/1999 Pond
2007/0096860 A1* 5/2007 Foster et al. ..... 337/36

* cited by examiner

*Primary Examiner*—Dean Takaoka
(74) *Attorney, Agent, or Firm*—Jaquelin K. Spong

(57) ABSTRACT

A multiple switch MEMS structure has a higher resistance, higher durability switch arranged in parallel with a lower resistance, less durable switch. By closing the higher resistance, high durability switch before the lower resistance, less durable switch, the lower resistance, less durable switch is protected from voltage transients and arcing which may otherwise damage the lower resistance, less durable switch. By appropriate selection of dimensions and materials, the high resistance, high durability switch may be assured to close first, as well as open first, thereby also protecting the lower resistance, less durable switch from voltage transients upon opening as well as upon closing.

20 Claims, 12 Drawing Sheets

MULTIPLE SWITCH MEMS STRUCTURE AND METHOD OF MANUFACTURE

CROSS REFERENCE TO RELATED APPLICATIONS

Not applicable.

STATEMENT REGARDING FEDERALLY SPONSORED RESEARCH

Not applicable.

STATEMENT REGARDING MICROFICHE APPENDIX

Not applicable.

BACKGROUND

This invention is directed to microelectromechanical systems (MEMS) which are used as electrical switches. In particular, this invention is directed to a MEMS structure which has a higher resistance, sacrificial switch as well as a lower resistance switch.

Microelectromechanical systems (MEMS) are devices which may be fabricated using semiconductor thin film technology in order to reduce the characteristic dimensions of the devices. MEMS technology is often applied to the design and fabrication of actuators, particularly those with a limited range of motion. MEMS technology has been applied to the design and fabrication of electrical switches, for example, to open and close contacts which form an electrical circuit. MEMS techniques may be used to batch fabricate small switches in large quantities relatively inexpensively, as lithographic processing techniques are employed.

One example of a prior art MEMS switch is shown in FIG. 1. MEMS switch 1 includes a cantilevered beam 4 carrying a shunt bar 6, which is lowered down onto a pair of contacts 5, to provide an electrical connection between the contacts 5, and thereby close the switch 1. The force for lowering or raising the cantilevered beam 4 is provided by, for example, a pair of electrostatic plates (not shown), if the switch is an electrostatic switch. However, it should be understood that other mechanisms may also be used to provide the force to close the switch, for example, electromagnetic forces.

A figure of merit for electrical switches is the residual resistance when the switch is in the "on" state. This residual resistance may determine the heat dissipated by the switch as well as the maximum frequencies which can be handled by the switch without unacceptable attenuation of the signal. In order to reduce this residual resistance as much as possible, the contact between the shunt bar 6 conductors and the contacts 5 needs to be as intimate as possible.

SUMMARY

Therefore, in order to make lower resistance contacts, the contact material tends to be relatively soft and compliant, in order to form a junction in which the metals are in intimate contact. Because the material is soft, it is relatively vulnerable to arcing, wherein high voltage, high current discharges occur across the contacts. The heat generated by the arcing may be sufficient to volatilize the soft material of the contacts, damaging the contacts irreversibly. Such arcing may therefore constitute a primary failure mode for low resistance switches.

In the multiple switch MEMS structure described here, the structure includes at least two switches, a first relatively high resistance, but durable sacrificial switch, and also a second lower resistance, less durable switch. The higher resistance, durable switch closes first, followed by the lower resistance, less durable switch. By closing the higher resistance, durable switch first, any arcing and high voltage discharge occurs across the higher resistance, durable switch. After any high voltage transients have passed, the lower resistance, less durable switch closes. Therefore, the "on" state of the switch has a low resistance dominated by the lower resistance, less durable switch, and the bulk of the on current flows through this switch. However, when the switch is first closed, the current and voltage is handled by the higher resistance, durable switch, thereby increasing the lifetime of the switch, by protecting the lower resistance switch from the high currents and high voltages occurring at the first closure of the switch.

The multiple switches are opened with the lower resistance, less durable switch opening before the higher resistance, higher durability switch, in order to protect the lower resistance, less durable switch from transients which may occur as the switch is opened.

The multiple switch MEMS structure may be designed using two independent cantilevered beams, or they may be designed as two separate contact points on a single cantilevered beam. In various exemplary embodiments, the geometry of the cantilevered beams may be designed such that the higher resistance, durable switch always closes first, followed by the lower resistance, less durable switch. In other exemplary embodiments, the control circuitry may be so designed as to actively close the higher resistance, higher durability switch first, followed by the lower resistance, less durable switch.

Therefore, according to the systems and methods disclosed herein, a multiple switch MEMS device has a lower resistance switch arranged in parallel with a higher resistance switch, wherein the higher resistance switch closes before the lower resistance switch and opens after the lower resistance switch, and wherein the resistance of the higher resistance switch is higher than the resistance of the lower resistance switch.

The resulting multiple switch MEMS device may be batch-fabricated inexpensively, using standard MEMS processing.

These and other features and advantages are described in, or are apparent from, the following detailed description.

BRIEF DESCRIPTION OF THE DRAWINGS

Various exemplary details are described with reference to the following figures, wherein.

DETAILED DESCRIPTION

In the systems and methods described herein, a multiple switch MEMS device includes a higher resistivity, highly durable sacrificial switch which closes before a second lower resistivity, less durable switch. In the exemplary embodiment described herein, the switch is actuated electrostatically. However, it should be understood that the systems and methods described herein may be applied to any of a number of alternative actuation mechanisms, such as electromagnetic.

Figure 1:
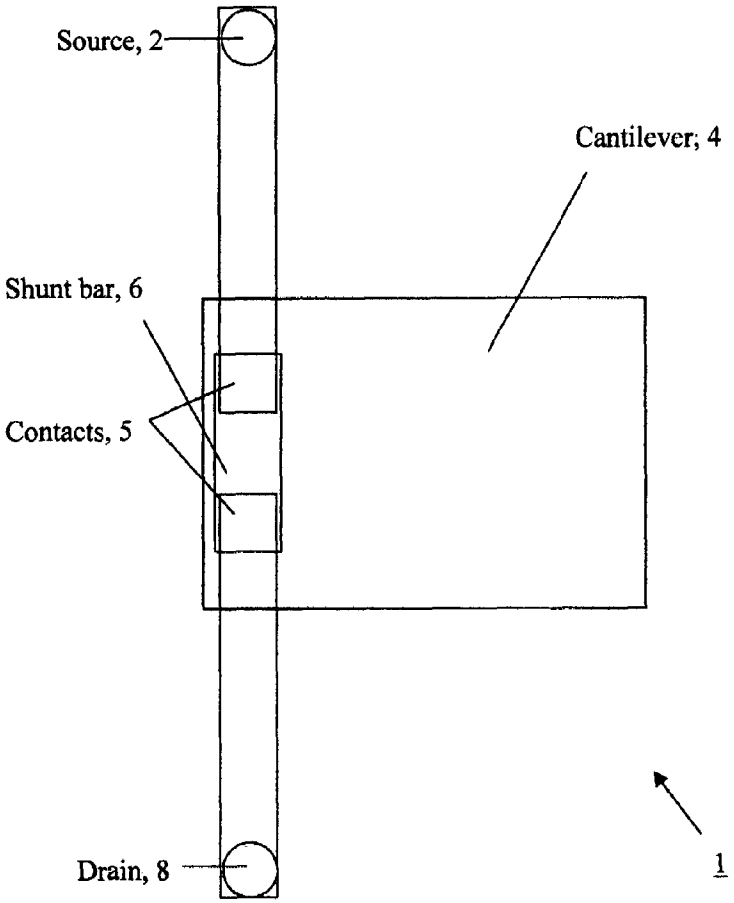
FIG. 1 is a schematic illustration of a prior art switch.
Figure 2:
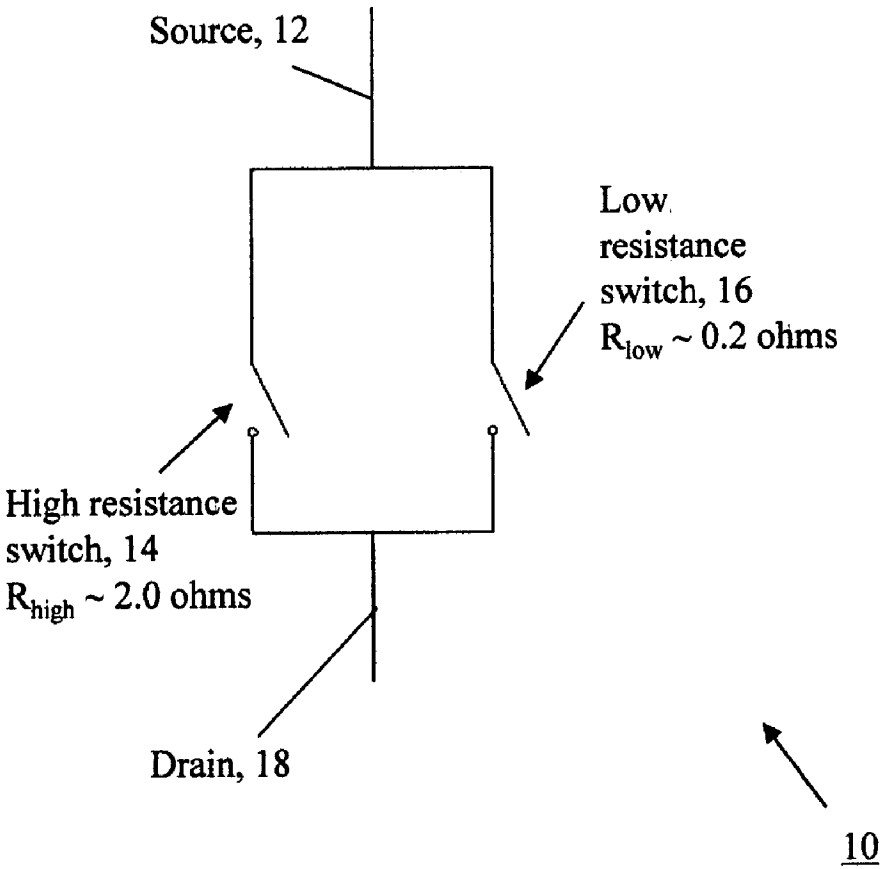
FIG. 2 is a diagram of an exemplary multiple switch MEMS structure.

FIG. 2 is an illustration of a first embodiment of a multiple switch MEMS structure. FIG. 2 shows two switches, a first, relatively high resistance, high durability sacrificial switch 14 and a relatively lower resistance, less durable switch 16. The two switches, higher resistance switch 14 and lower resistance switch 16 are arranged in parallel, between a source 12 and a drain 18 of current The higher resistance switch 14 may have a resistance of, for example, about 2.0 ohms, whereas the lower resistance switch 16 has a relatively lower resistance of, for example, about 0.2 ohms. More generally, the higher resistance switch 14 may have a contact resistance of at least 1 ohm, and the lower resistance switch 16 may have a contact resistance of less than 1 ohm. The total resistance $R_T$ of the circuit when the switches are arranged as shown in FIG. 2 is $$1/R_T=1/R_{low}+1/R_{high} \quad (1)$$

where $R_{low}$ and $R_{high}$ are the resistances of the lower and the higher resistance switches, respectively. For example, if $R_{low}$=0.2 ohms and $R_{high}$=2.0 ohms, the total resistance of the circuit $R_T$ is about 0.18 ohms.

The higher resistance switch 14 may have contact material that is hard, durable and able to withstand arcing. This material, however, may have a relatively high contact resistance due to its material properties. The lower resistance switch 16, may be made of soft material that is subject to damage if arcing occurs but has lower contact resistance.

The higher resistance, higher durability switch 14 may experience high heat generation during the initial contact because the lower resistance, less durable switch 16 has not made contact. Because this heating may correspond to a transient input of energy, the design of the higher resistance, higher durability switch 14 may be such that this heat can be absorbed by the materials of the device 10. Once the lower resistance, less durable switch 16 is in contact, the heat generated by the higher resistance, higher durability sacrificial switch 14 may drop, and the temperature may slowly drop as the device 10 reaches steady state conditions.

The switches 14 and 16 may be paired as a single switch 10. When the switch pair is actuated, the switches may move in a sequence that has the higher resistance switch 14 closing first and the lower resistance switch 16 closing next. At the moment of closure, voltage transients may exist on the signal line which may cause a relatively large amount of current to briefly flow through the higher resistance switch 14. By having the higher resistance switch 14 make electrical contact first, it will be subjected to the highest voltage potential between the contacts. This potential may cause an arc to occur. Because of the hard contact material, this switch may survive arcing due to hot switching. Once the higher resistance switch 14 is in contact, current may run through the higher resistance switch 14. This may lower the voltage potential across the contacts of the lower resistance switch 16. The lower resistance switch 16 may then be closed with little chance of damage due to arcing. The current may then flow primarily through the lower resistance switch 16.

Figure 3B:
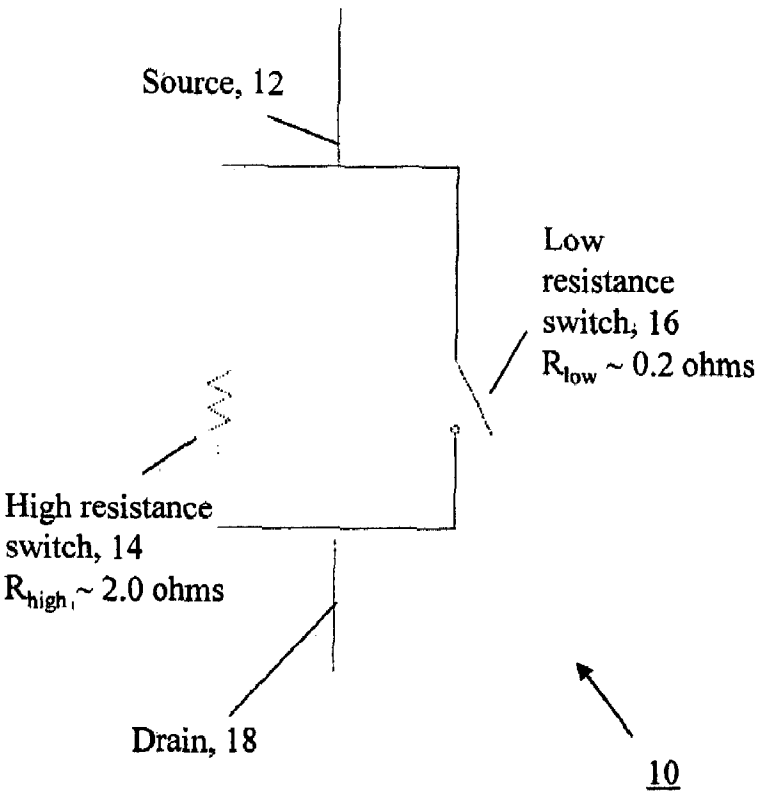
FIG. 3*b* is a circuit diagram corresponding to the situation illustrated in FIG. 3*a;*
Figure 3A:
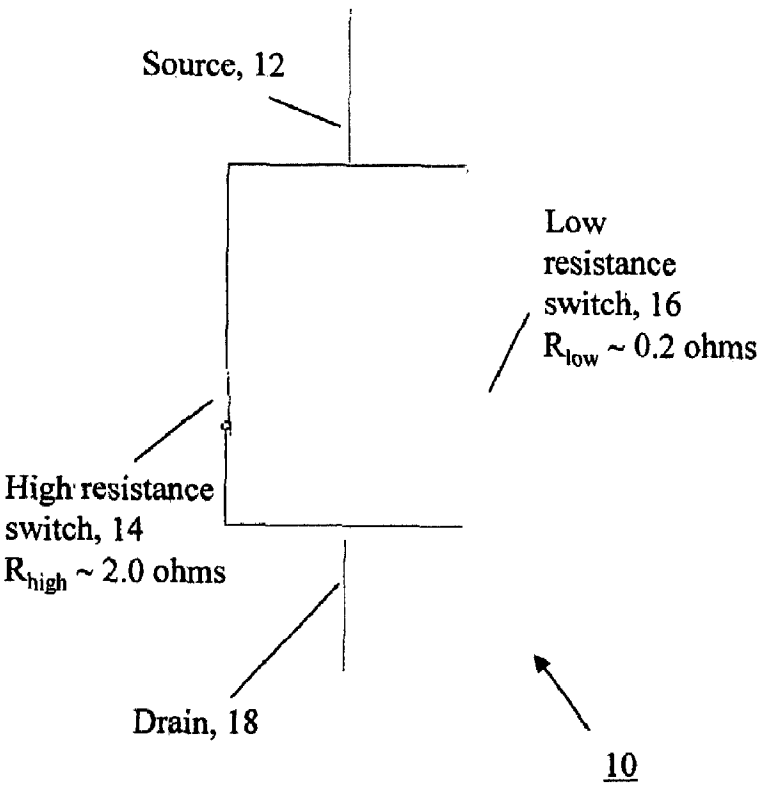
FIG. 3*a* is a diagram illustrating the closure of the higher resistance, higher durability sacrificial switch.

FIG. 3*a* shows a first step in the closure sequence outlined above. In the first step, the first, higher resistance switch 14 is closed. The circuit diagram corresponding to this situation is shown in FIG. 3*b*. Upon closure of the switch 14, switch 14 acts as a relatively large resistor in the circuit. The value of this resistor may be, for example, about 2.0 ohms.

Figure 4B:
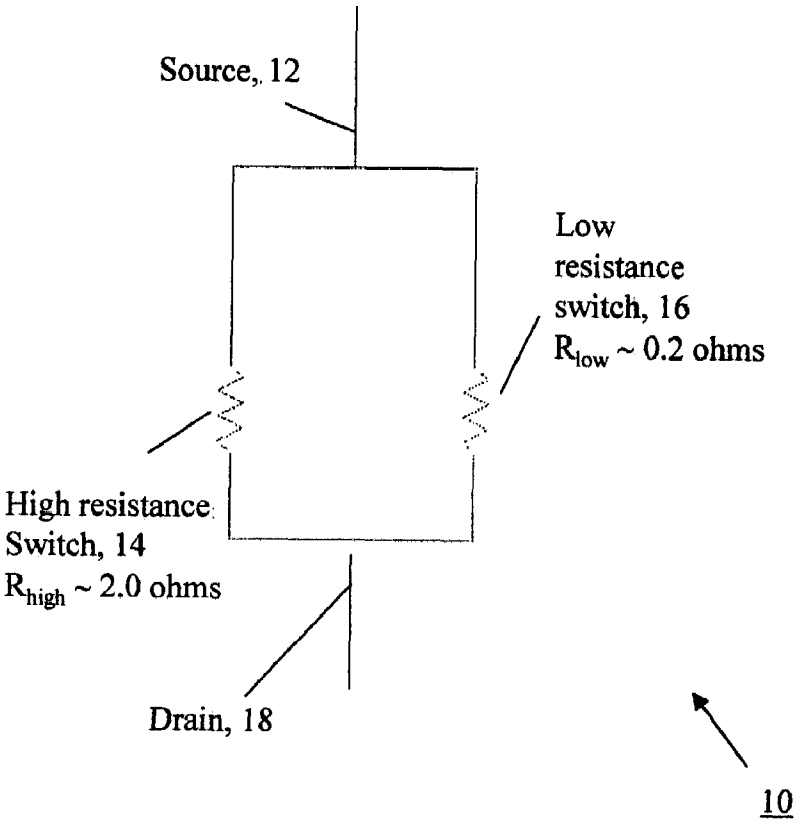
FIG. 4*b* is a circuit diagram corresponding to the situation illustrated in FIG. 4*a;*
Figure 4A:
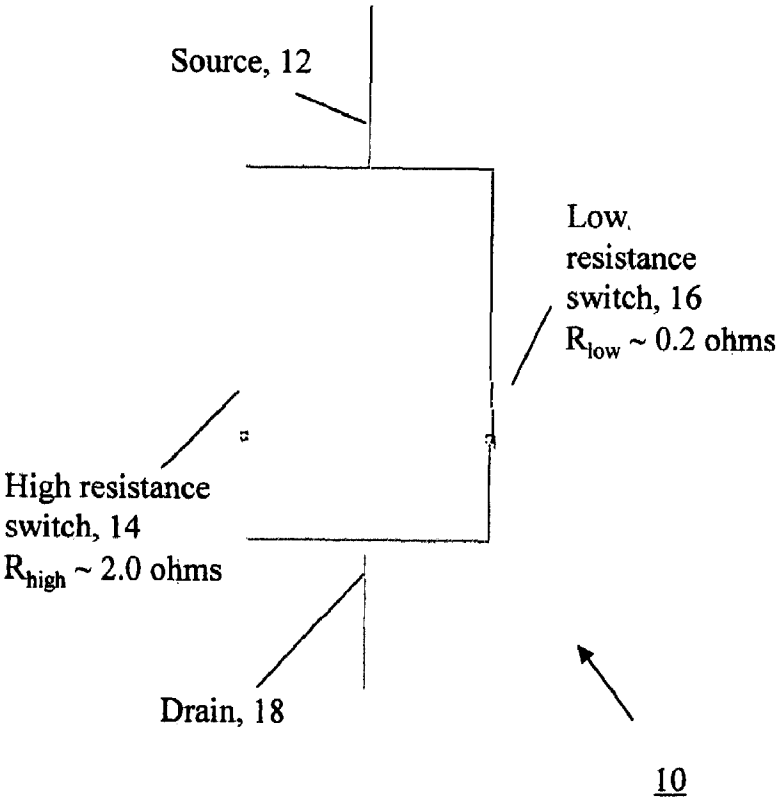
FIG. 4*a* is a diagram illustrating the closure of the lower resistance, less durable switch.

FIG. 4*a* shows a second step in the closure sequence outlined above. In the second step, the lower resistance switch 16 is closed. The circuit diagram corresponding to this situation is shown in FIG. 4*b*. Upon closure of the lower resistance switch 16, switch 16 acts as a relatively small resistor in the circuit. The value of this resistor may be, for example, about 0.2 ohms. As discussed above, the two switches 14 and 16 arranged in parallel act as a single, lower resistance connection between the source 12 and the drain 18, having a total resistance of; for example, about 0.18 ohms.

The timing of the opening and closing of higher resistance, high durability switch 14 relative to the opening and closing of lower resistance, less durable switch 16 may be controlled electronically, by activating switch 14 before switch 16 upon closing, and by activating switch 16 before switch 14 upon opening. However, this sequence may also be enforced by the design of the switches 14 and 16, as described in greater detail below.

Figure 5:
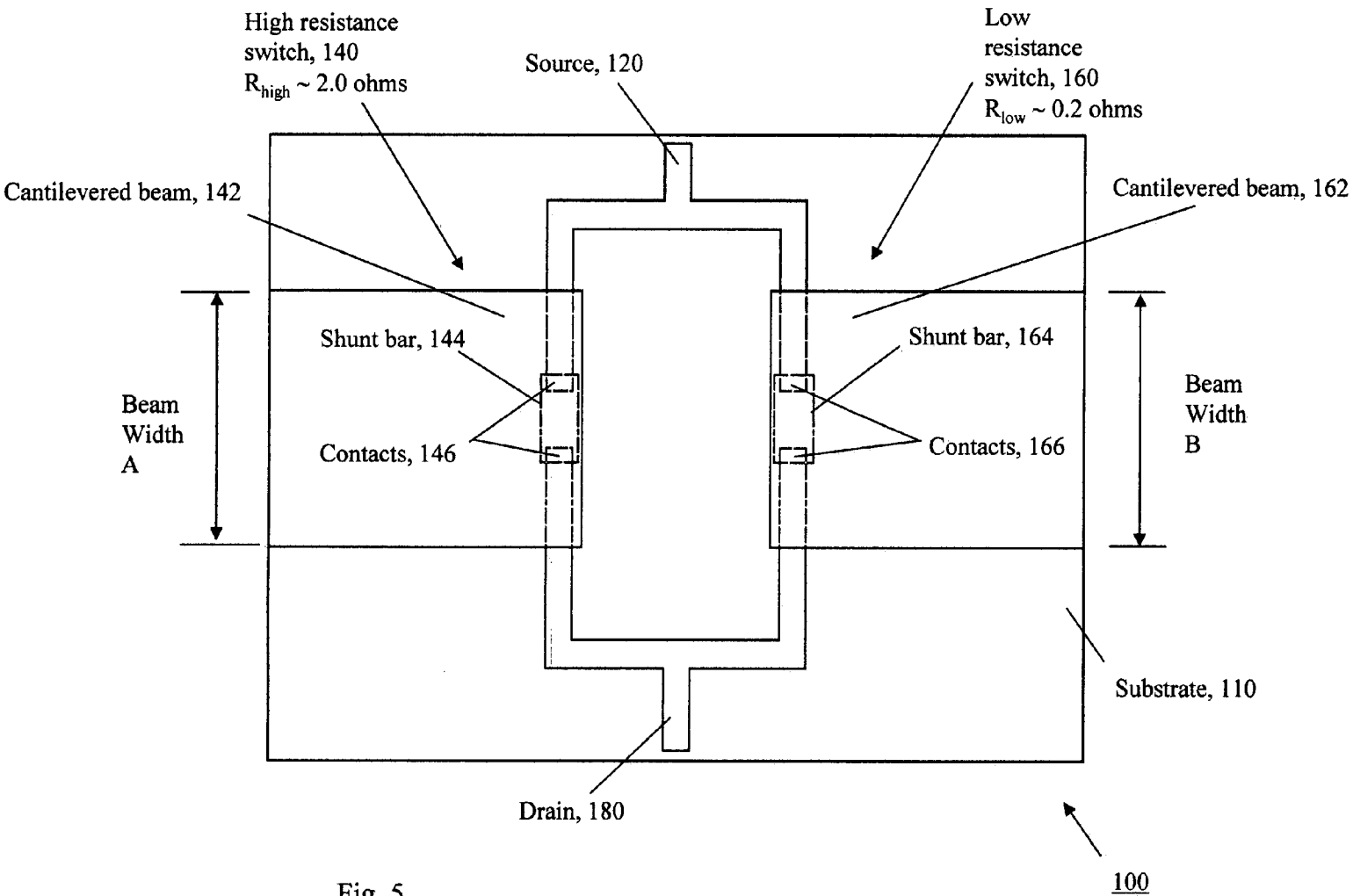
FIG. 5 is a plan view of a first exemplary embodiment of the multiple switch MEMS structure.

FIG. 5 is a plan view of a first exemplary embodiment of a multiple switch MEMS structure 100. MEMS structure 100 includes a first, relatively high resistance, high durability sacrificial switch 140 and a relatively lower resistance, less durable switch 160. The lower resistance, less durable switch 160 may be made of relatively soft, compliant materials which may deform upon contact to form an intimate, low-loss contact. In contrast, higher resistance, higher durability switch 140 may be made of relatively hard materials which do not deform upon contact, and therefore, form a relatively resistive contact. Higher resistance, higher durability switch 140 may include a cantilevered beam 142 which supports a shunt bar 144. When higher resistance, higher durability switch 140 is closed, cantilevered beam 142 may bend toward the contacts 146 deposited on the substrate, until the shunt bar 144 touches the contacts 146, providing an electrical connection between the contacts 146.

The contacts of higher resistance, higher durability switch 140, that is the shunt bar 144 and contacts 146 may be made of, for example, platinum, ruthenium, palladium, rhodium, platinum binary alloys, palladium alloys, and gold alloys.

The contacts of lower resistance, less durable switch 160, that is the shunt bar 164 and contacts 166 may be made from, for example, gold and gold alloys. The lower resistance, less durable switch 160 may even use liquid metal contacts, because the likelihood of arcing during hot switching is largely eliminated. Without the use of the higher resistance, higher durability switch 140, the low vapor pressure materials used for liquid contacts could be vaporized completely by arcing, thus causing a failure.

Figure 6:
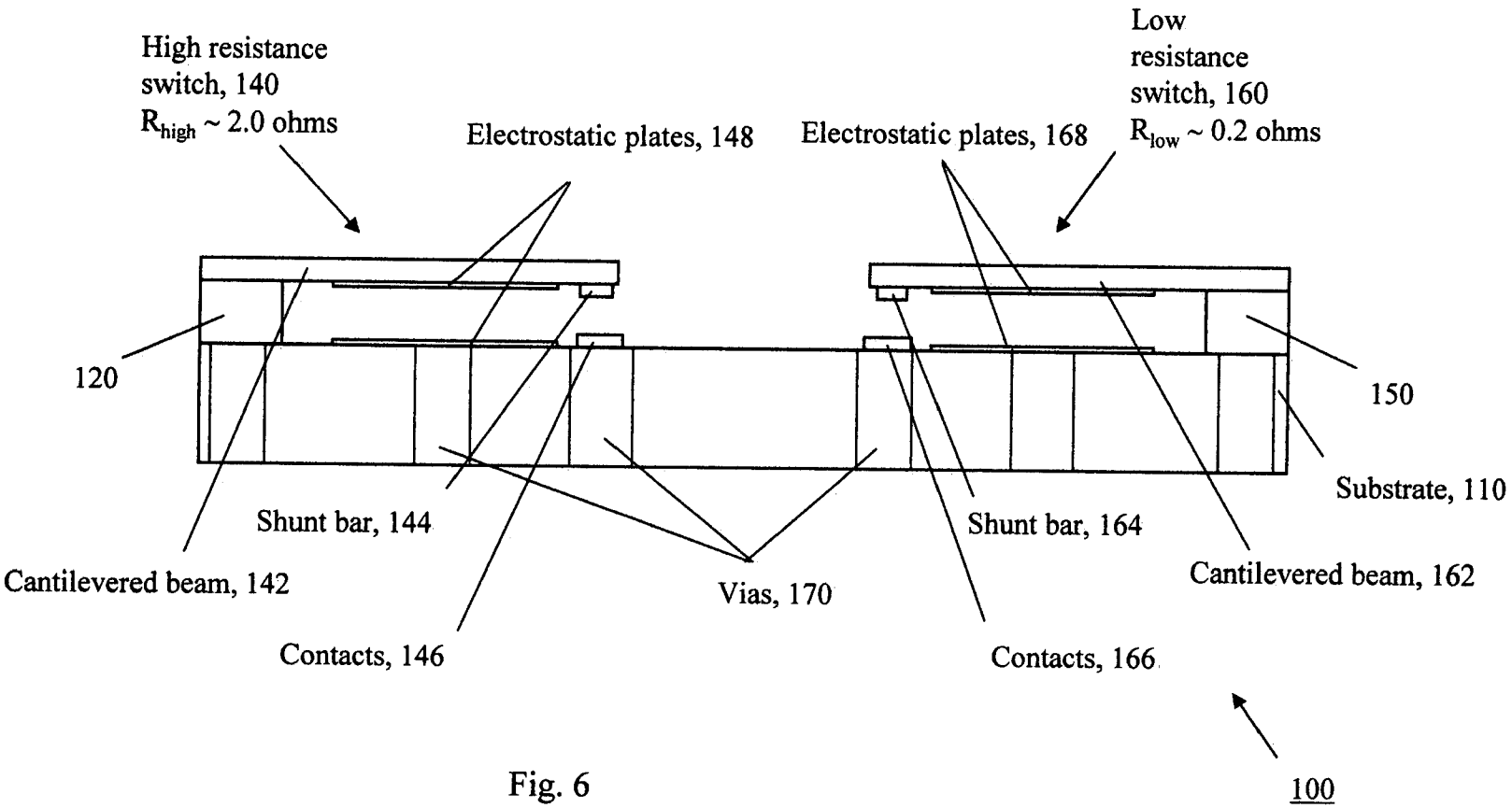
FIG. 6 is a cross sectional view of the exemplary embodiment illustrated in FIG. 5.

FIG. 6 is a cross sectional view of the first exemplary embodiment of the multiple switch MEMS structure 100. As shown in FIG. 6, the higher resistance, higher durability switch 140 includes a cantilevered beam 142 which is affixed to the substrate 110 by a standoff 120. The standoff 120 may be, for example, a photoresist pedestal or a silicon dioxide pedestal deposited on the substrate 110. The pedestal material may have been etched away from the other portions of the cantilevered beam 142, so that the remainder of the cantilevered beam 142 is freely suspended over the substrate 110.

Similarly, lower resistance, less durable switch 160 also includes a cantilevered beam 162, freely suspended over substrate 110, but attached to the substrate 110 by standoff 150. As shown in FIG. 6, each of cantilevered beams 142 and 162 bears a shunt bar 144 and 164, respectively. Also as shown in cross section, each of switches 140 and 160 includes a pair of electrostatic capacitor parallel plates 148 and 168, respectively. When either higher resistance, higher durability switch 140 or lower resistance, less durable switch 160 is to be closed, a voltage is applied to capacitor plates 148 or 168, which draws either cantilevered beam 142 or cantilevered beam 162 toward the substrate 110. As the cantilevered beams approach the substrate, either shunt bar 144 or 164 touches the contacts 146 or 166, respectively, closing either higher resistance, higher durability switch 140 or lower resistance, less durable switch 160.

In some exemplary embodiments, higher resistance, higher durability switch 140 may be closed before lower resistance, less durable switch 160 by applying the voltage to electrostatic plates 148 before applying a voltage to electrostatic plates 168. Arc suppression circuits such as R-C circuits may also be used to protect the higher resistance, higher durability sacrificial switch 140 and even the lower resistance, less durable switch 160 if the time gap between actuations of both switches 140 and 160 is small.

However, in other exemplary embodiments, the voltages may be applied to electrostatic plates 148 simultaneously with electrostatic plates 168, but higher resistance, higher durability switch 140 may be made to close before lower resistance, less durable switch 160 may making use of kinematic effects. For example, cantilevered beam 142 may be made less stiff than cantilevered beam 162, such that cantilevered beam 142 moves more easily and faster more in response to the electrostatic force applied to parallel plates 148, and therefore closes switch 140 before switch 160 closes. Cantilevered beam 142 may be made less stiff than cantilevered beam 162 by making cantilevered beam 142 narrower or thinner than cantilevered beam 162. For example, beam width "A" for higher resistance, higher durability switch 140 shown in FIG. 5 may be narrower than beam width "B" for lower resistance, less durable switch 160. Accordingly, through appropriate selection of beam geometry, the desired dynamic timing of the switches 140 and 160 can be created simply.

In one exemplary embodiment, cantilevered beam 162 may be made to close more slowly than cantilevered beam 162 by making cantilevered beam 162 100 μm across, whereas cantilevered beam 142 is, for example, 50 μm across. Each of cantilevered beams 142 and 162 are fabricated from silicon of about 150 μm long and 10 μm thick, resulting in a spring constant of 704 N/m for cantilevered beam 142 and 1407 N/m for cantilevered beam 162. Because cantilevered beam 162 is stiffer than cantilevered beam 142, it may deflect less rapidly, and therefore, lower resistance, less durable switch 160 may be guaranteed to close after higher resistance, higher durability switch 140.

Although less straightforward to manufacture, cantilevered beam 142 may also be made less stiff than cantilevered beam 162 by making beam 142 thinner, or from a material which is inherently less stiff than the material of cantilevered beam 142. The size of the capacitive drive plates may also be reduced on cantilevered beam 162 in order to reduce the drive force and thus slow the closing speed.

Because the spring constant of the higher resistance, higher durability switch 140 is necessarily lower than the spring constant of the lower resistance, less durable switch 160, the switches will open in the reverse order. That is, because of its larger spring constant, the lower resistance, less durable switch 160 will undergo larger accelerations upon the cessation of the voltages on electrostatic plates 148 and 168. Therefore, lower resistance, less durable switch 160 will necessarily open before the higher resistance, higher durability switch 140. Therefore, upon opening, the higher resistance, higher durability switch is caused to manage any voltage transients that may occur at the opening of the switches.

Figure 7:
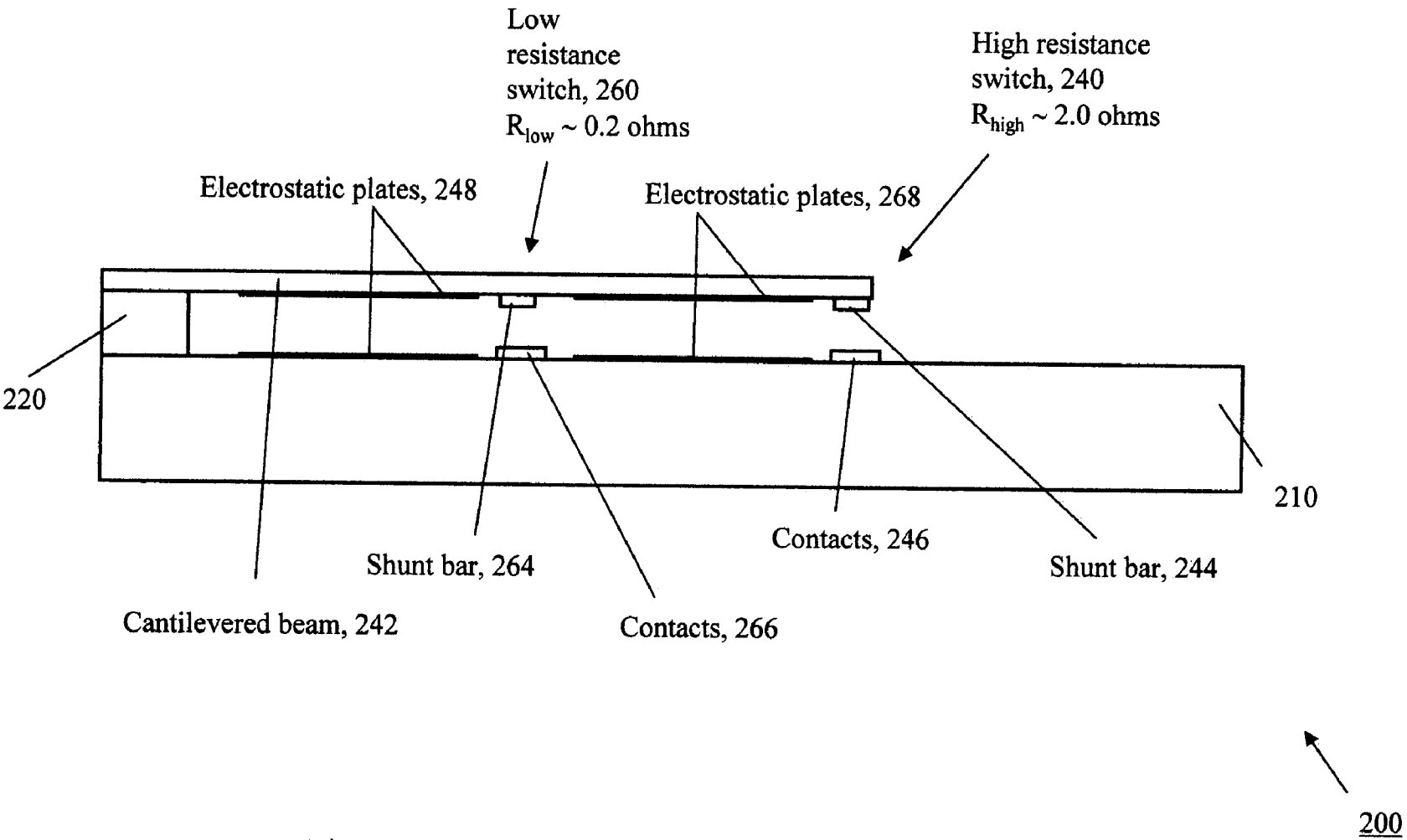
FIG. 7 is a cross sectional view of a second exemplary embodiment of a dual MEMS switch using a single cantilevered beam.

The two switches, higher resistance switch 140 and lower resistance switch 160 may also be formed on a single cantilevered beam, by placing the higher resistance switch outboard of the lower resistance switch, relative to the cantilever point of the beam. Such an embodiment is depicted in FIG. 7. FIG. 7 is a cross sectional view of a single cantilevered multiple switch MEMS structure 200. As shown in FIG. 7, single cantilevered multiple switch MEMS structure 200 includes a higher resistance, higher durability switch 240 with a shunt bar 244 which is formed at the distal, freely suspended end of a cantilevered beam 242, and a lower resistance, less durable switch 260 with a shunt bar 264, disposed at an intermediate point along the length of the cantilevered beam 242, between the proximal and distal ends. The cantilevered beam 242 is attached to substrate 210 by standoff 220 at one end of cantilevered beam 242.

Figure 8:
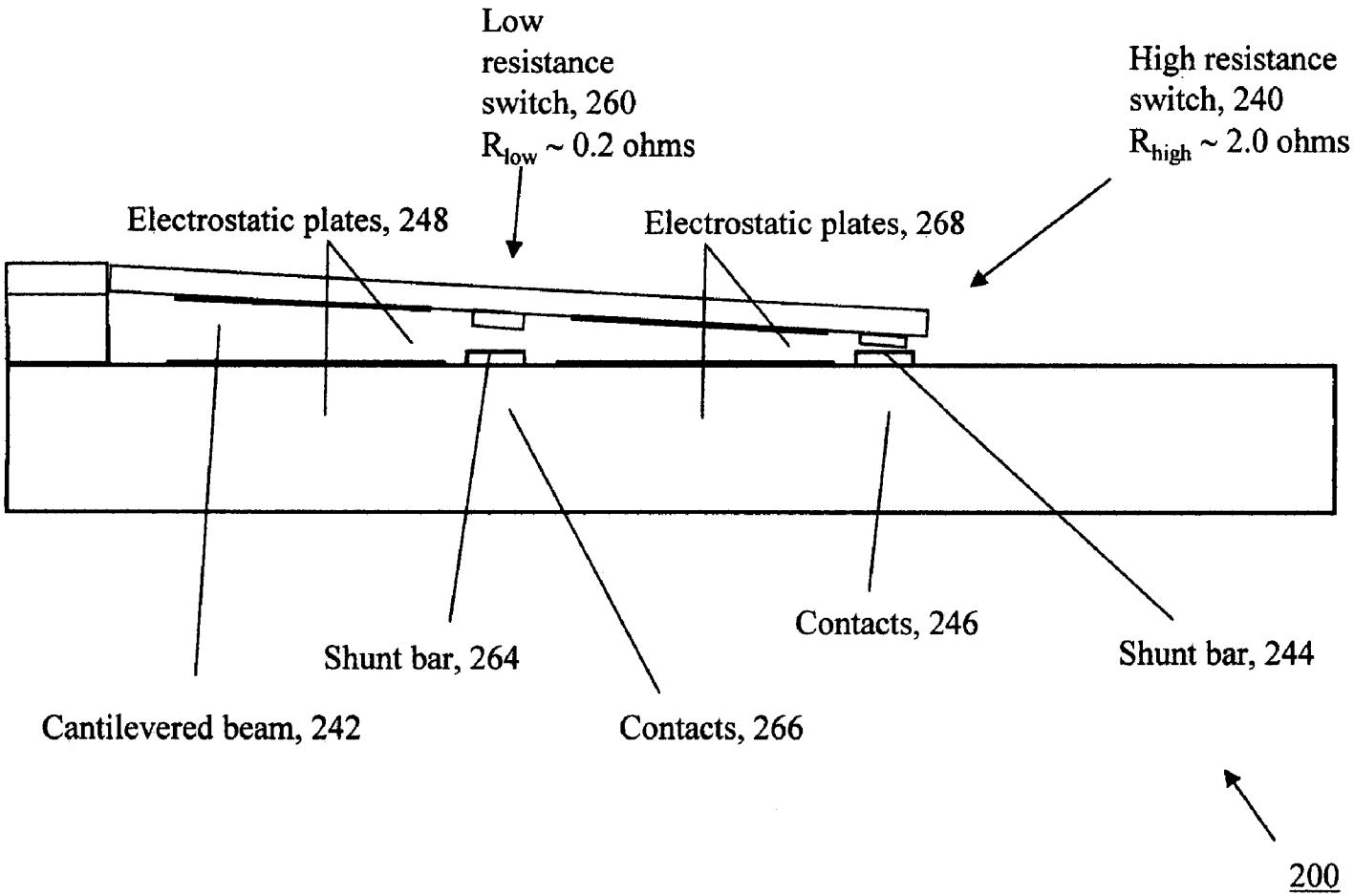
FIG. 8 is a cross sectional view of the second exemplary embodiment after the closure of the higher resistance, higher durability switch on the single cantilevered beam of FIG. 7.

As a voltage is applied to electrostatic plates 248 and 268, the cantilevered beam 242 bends toward substrate 210 with the freely suspended end bending closer to the substrate 210 because of the longer lever arm between the freely suspended beam end and the cantilever point 220. Because the freely suspended end is deflected to a greater degree than any intermediate point, the higher resistance, higher durability switch 240 closes the contacts 246 before the lower resistance, less durable switch 260. This situation is depicted in FIG. 8.

Figure 9:
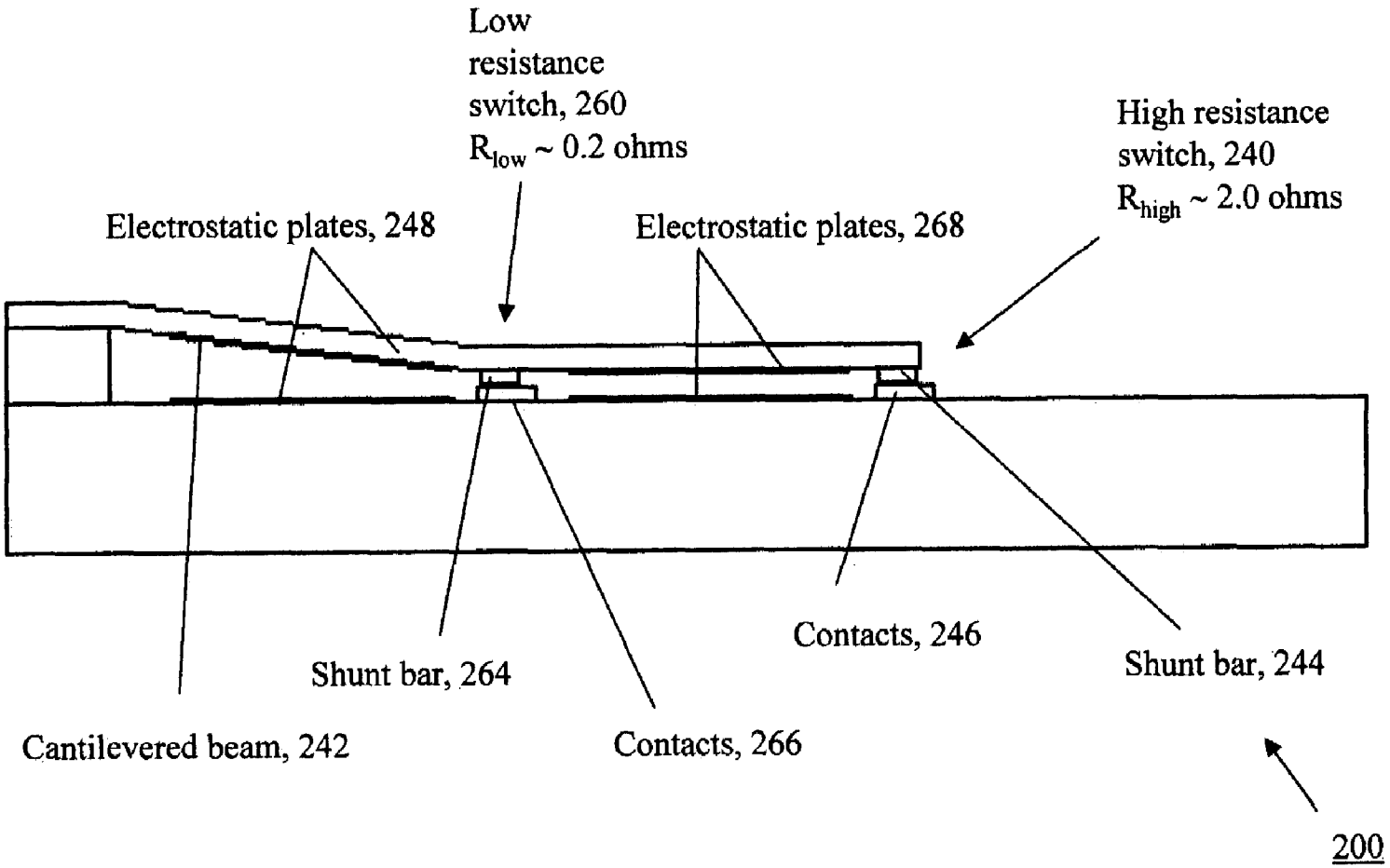
FIG. 9 is a cross sectional view of the second exemplary embodiment after the closure of the lower resistance, less durable switch on the single cantilevered beam of FIG. 7.

After higher resistance, higher durability switch 240 has closed, the cantilevered beam 242 continues to bend due to the force between electrostatic plates 268. The force required to further deflect cantilevered beam 242 may be greater, because of the shorter lever arm between the intermediate point and the cantilevered point 220. As the voltage is applied to electrostatic plates 268, the cantilevered beam 242 is bent sufficiently to close the lower resistance, less durable switch 260 located at the intermediate point, as depicted in FIG. 9.

Because of the spring constant of the higher resistance, higher durability switch 240 is necessarily lower than the spring constant of the lower resistance, less durable switch 260, the switches will open in the reverse order. That is, because of its larger spring constant, the lower resistance, less durable switch 260 will necessarily open before the higher resistance, higher durability switch 240. Therefore, since the lower resistance, less durable switch 260 opens before the higher resistance, higher durability switch 240, the higher resistance, higher durability switch 240 is caused to manage any voltage transients that may occur at the opening of the switches.

Figure 10:
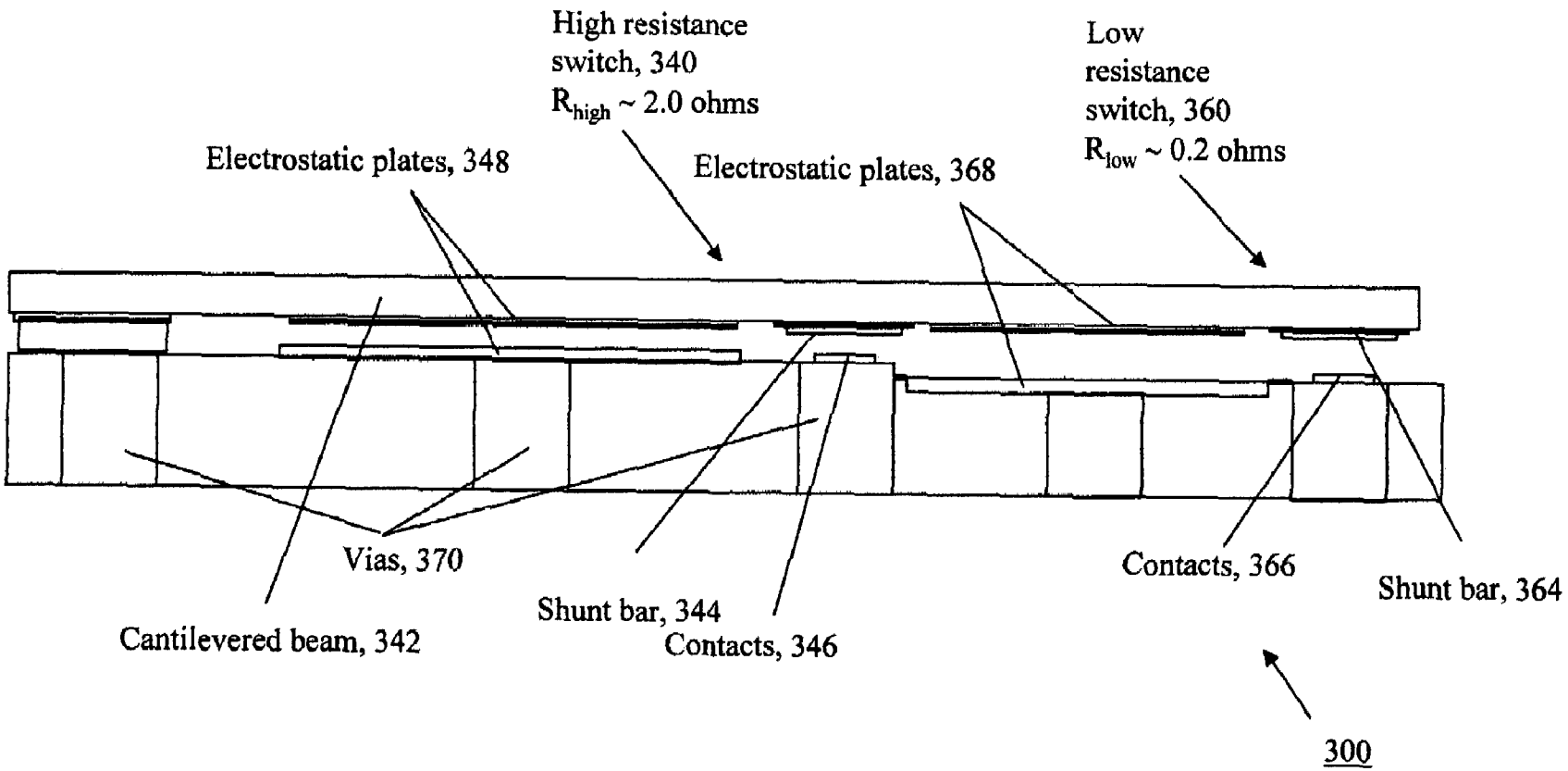
FIG. 10 is a cross sectional view of a third exemplary embodiment of a multiple switch MEMS structure using a single cantilevered beam.

The multiple switch MEMS structure may not necessarily have the higher resistance, higher durability switch placed on the distal end of the cantilever, outboard of the lower resistance, less durable switch. FIG. 10 illustrates another exemplary embodiment 300 of the multiple switch MEMS structure, wherein the higher resistance, higher durability switch 340 is located at the intermediate point, and the lower resistance, less durable switch 360 is located on the distal, freely suspended end of the cantilevered beam 342. In this exemplary embodiment, the terrain of the substrate 310 may be relieved to provide greater clearance between the contacts 366 and the shunt bar 364 for the lower resistance switch 360, compared to the clearance between the contacts 346 and the shunt bar 344 for the higher resistance switch 340. Because of reliefs etched into the substrate 310, electrostatic plates 368 are separated by a larger distance than electrostatic plates 348. Therefore, they exert a smaller force on the end of cantilevered beam 342. In addition, the relieved areas provide a greater distance between the contacts 366 and the shunt bar 364 for the lower resistance switch 360. Because of the greater distance and lower force, lower resistance, less durable switch 360 will close after the higher resistance, higher durability switch 340 located at the intermediate point.

As was the case with multiple switch MEMS structure 200, as a result of the design of multiple switch MEMS structure 300, the lower resistance, less durable switch 360 may open before the higher resistance, higher durability switch 340.

Figure 11:
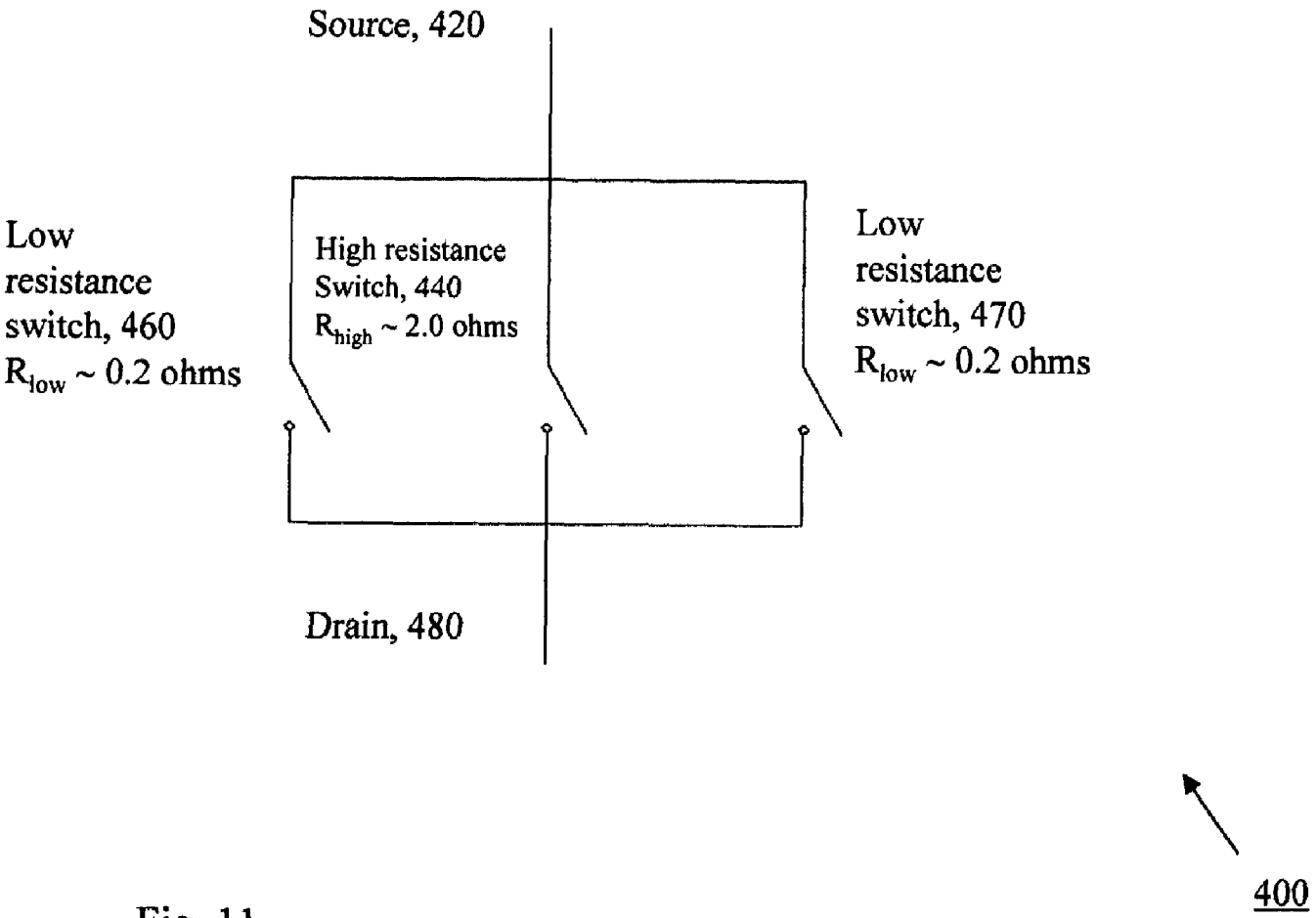
FIG. 11 illustrates a MEMS device using multiple lower resistance, less durable sacrificial switches.

Finally, multiple switch MEMS structure may have more switches in parallel than the pair of one higher resistance, higher durability switch and one lower resistance, less durable switch. FIG. 11 illustrates a multiple switch MEMS structure 400, wherein two or more lower resistance, less durable switches 460 and 470 are arranged in parallel with a single higher resistance, higher durability switch 440. In this arrangement, a single higher resistance, higher durability switch can act as a sacrificial switch for two lower resistance, less durable switches. This may help reduce the chip area consumed by the parallel switch arrangement, and therefore reduce costs.

Figure 12:
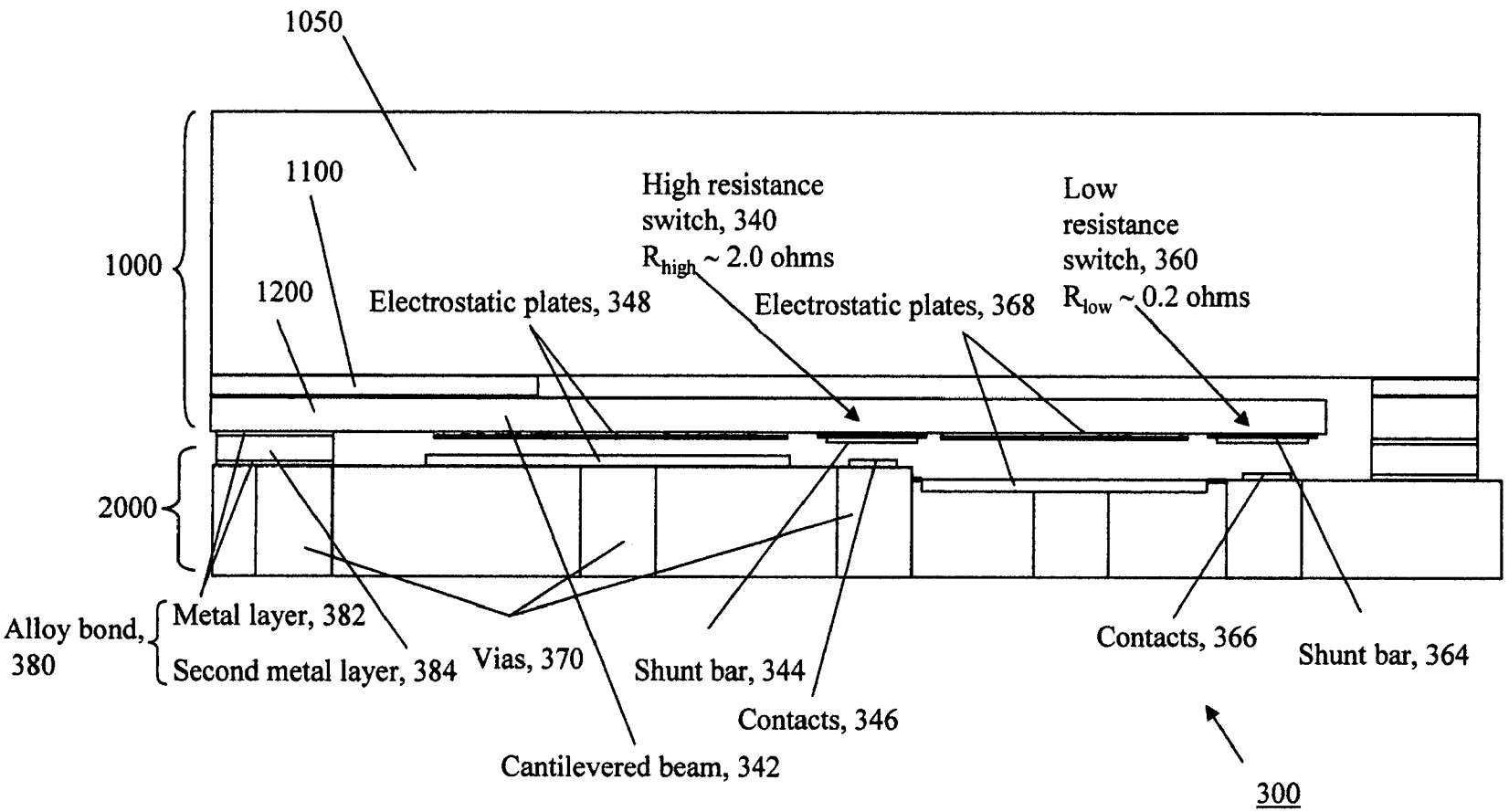
FIG. 12 is a cross sectional view illustrating the construction of the multiple switch MEMS structure of FIG. 10.

Any of multiple switch MEMS structures 100-400 may be fabricated using standard MEMS bulk or surface machining techniques. For example, multiple MEMS structure 300 may be fabricated on two separate substrates, such as illustrated by FIG. 12. FIG. 12 is a cross sectional view of the multiple switch MEMS structure 300 of FIG. 10 being fabricated on two substrates 1000 and 2000. Cantilevered beam 342 and shunt bars 344 and 364 are formed on one substrate 1000, and the contacts 346 and 366 are formed on a second substrate 2000. The shunt bars 344 and 364 may be formed by depositing a layer or a multilayer of conductive materials onto the first substrate 1000. The material of the shunt bars 344 and 364 may be the same as the materials described below for the contacts 346 and 366.

The outline of the cantilevered beam 342 may then be formed by deep reactive ion etching (DRIE) on, for example, on a silicon-on-insulator substrate 1000. The silicon-on-insulator substrate 1000 is a composite wafer including a relatively thick silicon "handle" wafer 1050 about 675 μm thick, on which a thin (about 1 μm) layer of silicon dioxide 1100 is grown or deposited. A relatively thin (about 50 μm) silicon "device" layer 1200 is coupled to the silicon dioxide layer 1100 to complete the composite silicon-on-insulator substrate. The thin layer of silicon dioxide 1100 may form a convenient etch stop for the deep reactive ion etching process. The cantilevered beam 342 formed by deep reactive ion etching (DRIE) in the device layer 1200 may be released by wet etching the thin silicon dioxide layer 1100 over most of the length of the cantilevered beam 342, with the exception of the silicon dioxide layer attachment point 1100, in a solution of, for example, 49% hydrofluoric (HF) acid and water. FIG. 12 depicts the silicon-on-insulator substrate 1000 with silicon dioxide layer attachment point 1100 and the cantilevered beam 342 formed in the silicon device layer 1200.

The contacts 346 and 366 and the lower electrostatic plates may be formed on the second substrate, at the locations of vias 370 formed in the second substrate 2000. The vias 370 may be through-wafer vias, which are conductive paths formed through the thickness of the second substrate 2000. For example, the through wafer vias 370 may be formed by plating conductive material into a trench formed in the front side of a substrate, and removing material from the backside of the substrate to reveal the plated material and form the through wafer via 370. The plated conductive material may be, for example, copper (Cu).

The conductive materials of the contacts 346 and 366 and lower electrostatic plates may be sputter-deposited on the second substrate 2000 by, for example, ion beam deposition (IBD). The conductive materials may be a multilayer which includes an adhesion layer such as chromium (Cr), and an antidiffusion layer such as molybdenum (Mo), and a highly conductive layer such as gold (Au). Exemplary thicknesses of the adhesion layer, antidiffusion layer and conductive layer may be, for example, about 50 to about 100 Angstroms of the adhesion layer Cr, about 100 to about 200 Angstroms of the antidiffusion layer Mo, and about 3000 to about 5000 Angstroms of the conductive layer Au.

The first substrate 1000 may then be coupled to the second substrate 2000 with, for example, a hermetic seal such as a metal alloy bond 380. The hermetic seal may prevent a particular gas environment from leaking out of the sealed MEMS structure, over the lifetime of the structure. For example, if the structure is intended to maintain good isolation characteristics when subjected to relatively high voltage signals such as lightening strikes on telephone circuits, it may be desirable to surround the MEMS structure in an insulating gas, to discourage the breakdown of the gas in an arc. To form the hermetic seal, a first metal layer 382 may be deposited upon the first and the second substrates. The metal layer 382 may form a bondline which may completely circumscribe the multiple switch MEMS structure 300. The first metal layer 382 may be the adhesion/antidiffusion/conductive multilayer described above. A second metal layer 384 may then be deposited upon the first metal layer 382 on either the first or the second substrate. The second metal layer 384 may be, for example, indium (In), which may be deposited by electroplating, for example. The first substrate 1000 and the second substrate 2000 may then be assembled together with pressure applied to the first substrate against the second substrate. The assembly may then be heated to a temperature exceeding the melting point of the first metal layer 382 or the second metal layer 384, causing it to flow into and form a metal alloy bond 380 with the other metal. The alloy forms the hermetic metal bond 380 between the first substrate 1000 and the second substrate 2000. In one exemplary embodiment, the first metal layer 382 may be Au or the Au multilayer described above, and the second metal layer 384 may be In, such that the alloy formed upon heating may be $AuIn_2$. The process temperature for melting the layer of indium may be, for example, about 160 to about 180 degrees centigrade, whereas the melting point of indium is about 156 degrees centigrade.

While FIG. 12 illustrates an exemplary fabrication method for multiple switch MEMS structure 300, it should be understood that similar procedures may be employed to fabricate any of multiple switch MEMS structures 100-400.

Additional details regarding fabrication techniques for the cantilevered switch, metal alloy seal and the through-wafer vias may be found in U.S. patent application Ser. No. 11/211,623 (Attorney Docket No. IMT-Wallis), U.S. patent application Ser. No. 11/211,622 (Attorney Docket No. IMT-Preform) and U.S. patent application Ser. No. 11/211,624 (Attorney Docket No. IMT-Blind Trench), each of which is incorporated by reference in its entirety.

While various details have been described in conjunction with the exemplary implementations outlined above, various alternatives, modifications, variations, improvements, and/or substantial equivalents, whether known or that are or may be presently unforeseen, may become apparent upon reviewing the foregoing disclosure. While the embodiments described above relate to a MEMS cantilevered switch, it should be understood that the systems and methods described herein may be applied to non-cantilevered switch designs as well. Furthermore, the steps of the method described for forming the multiple switch MEMS structure need not be carried out in the exact order described. Lastly, details relating to the layout of the switches, and the number thereof, are intended to be illustrative only, and the invention is not limited to such embodiments. Accordingly, the exemplary implementations set forth above, are intended to be illustrative, not limiting.

What is claimed is:

1. A micromechanical structure comprising:

at least one lower resistance switch arranged in parallel with at least one higher resistance switch on a surface of a substrate, wherein the at least one higher resistance switch closes before the at least one lower resistance switch and opens after the at least one lower resistance switch, and wherein the resistance of the at least one higher resistance switch is higher than the resistance of the at least one lower resistance switch.

2. The micromechanical structure of claim 1, wherein the lower resistance switch and the higher resistance switch both comprise a cantilevered beam, wherein the cantilevered beam of the higher resistance switch is less stiff than the cantilevered beam of the lower resistance switch.

3. The micromechanical structure of claim 2, wherein the cantilevered beam of the higher resistance switch is at least one of narrower and thinner than the cantilevered beam of the lower resistance switch.

4. The micromechanical structure of claim 1, further comprising a cantilevered beam having a proximal and a distal end, wherein the higher resistance switch is disposed on the distal end of a cantilevered beam, and the lower resistance switch is disposed on an intermediate point between the proximal end and the distal end of the cantilevered beam.

5. The micromechanical structure of claim 1, further comprising a cantilevered beam having a proximal and a distal end, wherein the lower resistance switch is disposed on the distal end and the higher resistance switch is disposed at an intermediate point between the proximal and the distal end, and wherein a contact for the lower resistance switch is placed at a greater distance from a shunt bar on the cantilevered beam than the contacts for the higher resistance switch, when the switch is not energized.

6. The micromechanical structure of claim 1, wherein contacts of the lower resistance switch are softer than contacts of the higher resistance switch.

7. The micromechanical structure of claim 1, wherein the higher resistance switch has a resistance of at least 1 ohm, and the lower resistance switch has a resistance of less than 1 ohm.

8. The micromechanical structure of claim 6, wherein the contacts of the higher resistance switch comprise at least one of platinum, ruthenium, palladium, rhodium, platinum binary alloys, palladium alloys, and gold alloys.

9. The micromechanical structure of claim 6, wherein the contacts of the lower resistance switch comprise at least one of gold and a gold alloy.

10. The micromechanical structure of claim 2, further comprising:

at least one electrostatic plate and at least one contact formed on the substrate adjacent to the cantilevered beams.

11. The micromechanical structure of claim 4, further comprising at least one electrostatic plate and at least one contact formed on the substrate adjacent to the cantilevered beam.

12. The micromechanical structure of claim 10, further comprising a first through via, which provides a conductive path through the substrate to the at least one contact formed on the substrate.

13. The micromechanical structure of claim 10, further comprising a second through via which provides a conductive path through the substrate to the at least one electrostatic plate formed on the substrate.

14. A method of using the micromechanical structure of claim 1, comprising:

closing the at least one higher resistance switch; and then closing the at least one lower resistance switch.

15. The method of claim 14, further comprising:

opening the lower resistance switch; and then opening the higher resistance switch.

16. A method of forming a micromechanical structure, comprising:

forming at least one higher resistance switch on a surface of a first substrate;

forming at least one lower resistance switch on the surface of the first substrate in parallel with the higher resistance switch, wherein the at least one higher resistance switch closes before the at least one lower resistance switch and opens after the at least one lower resistance switch, and wherein the resistance of the at least one higher resistance switch is higher than the resistance of the at least one lower resistance switch.

17. The method of claim 16, wherein forming at least one higher resistance switch and forming at least one lower resistance switch comprises forming the higher resistance switch with a first cantilevered beam and forming the lower resistance switch with a second cantilevered beam, wherein the first cantilevered beam is less stiff than the second cantilevered beam.

18. The method of claim 17, wherein forming the at least one higher resistance switch and forming the at least one lower resistance switch further comprises:

forming at least one electrostatic plate and at least one contact on a surface of a second substrate;

coupling the first substrate to the second substrate with a hermetic seal.

19. The method of claim 18, further comprising:

forming at least one through via in the second substrate, to provide electrical access to at least one of the electrostatic plate and the contact.

20. The method of claim 17, wherein the first cantilevered beam of the higher resistance switch is at least one of narrower and thinner than the second cantilevered beam of the lower resistance switch.

* * * * *